US008579246B2

(12) United States Patent
Chang

(10) Patent No.: US 8,579,246 B2
(45) Date of Patent: Nov. 12, 2013

(54) ANGLE ADJUSTING STAND

(76) Inventor: Chun Yuan Chang, Taipei (TW)

( * ) Notice: Subject to any disclaimer, the term of this patent is extended or adjusted under 35 U.S.C. 154(b) by 3 days.

(21) Appl. No.: 13/113,290

(22) Filed: May 23, 2011

(65) Prior Publication Data

US 2012/0298827 A1 Nov. 29, 2012

(51) Int. Cl.
*A47G 1/24* (2006.01)

(52) U.S. Cl.
USPC ..... 248/455; 248/371; 248/292.12; 248/922

(58) Field of Classification Search
USPC ..... 248/453–455, 121, 126, 127, 131–133, 248/136, 917, 923, 396, 460, 462–465, 447, 248/451, 444.1, 458, 448, 393, 397, 922, 248/292.12, 292.11, 371; 281/45, 42, 43; 40/400–403, 47, 48; 211/169, 169.1, 211/165, 168, 167, 47, 48, 40, 41.6, 41.7, 211/41.12, 45, 50, 70, 85, 126.6, 126.13, 211/126.14, 130.1
See application file for complete search history.

(56) References Cited

U.S. PATENT DOCUMENTS

| | | | | |
|---|---|---|---|---|
| 2,743,550 | A * | 5/1956 | Felice | 248/457 |
| 4,917,343 | A * | 4/1990 | Wainscott | 248/447.2 |
| 5,016,849 | A * | 5/1991 | Wu | 248/176.3 |
| 5,720,466 | A * | 2/1998 | Skipper | 248/460 |
| 6,068,299 | A * | 5/2000 | Peltzer | 281/45 |
| 6,202,973 | B1 * | 3/2001 | Navarin et al. | 248/444 |
| 6,776,385 | B1 * | 8/2004 | Chang | 248/448 |
| 6,802,486 | B2 * | 10/2004 | Weingartner | 248/454 |
| 6,918,565 | B2 * | 7/2005 | Chang | 248/448 |
| 6,959,822 | B2 * | 11/2005 | Caplan et al. | 211/40 |
| 6,974,038 | B2 * | 12/2005 | Caplan et al. | 211/40 |
| 7,017,871 | B2 * | 3/2006 | Chen | 248/161 |
| 7,404,233 | B2 * | 7/2008 | Lu et al. | 16/302 |
| 7,431,254 | B2 * | 10/2008 | Cheng | 248/292.12 |
| 7,448,588 | B2 * | 11/2008 | Sung | 248/351 |
| 7,520,484 | B1 * | 4/2009 | Kamath et al. | 248/447 |
| 7,686,272 | B2 * | 3/2010 | King | 248/448 |
| 7,690,605 | B2 * | 4/2010 | Lee et al. | 248/133 |
| 7,726,616 | B2 * | 6/2010 | Zhang et al. | 248/284.1 |
| 7,922,138 | B2 * | 4/2011 | Benfield et al. | 248/276.1 |
| 8,266,834 | B2 * | 9/2012 | Chen et al. | 40/749 |
| 8,387,938 | B2 * | 3/2013 | Lin | 248/456 |
| 2003/0080272 | A1 * | 5/2003 | Toghanian | 248/448 |
| 2006/0255229 | A1 * | 11/2006 | Cheng | 248/458 |
| 2009/0283655 | A1 * | 11/2009 | Fukuda et al. | 248/454 |
| 2010/0012812 | A1 * | 1/2010 | Hu | 248/454 |

* cited by examiner

*Primary Examiner* — Terrell McKinnon
*Assistant Examiner* — Monica Millner

(57) ABSTRACT

An angle adjusting stand contains two bases, each including a hole, at least one limiting aperture, an engaging portion, and plural first locking faces; two adjusting devices, each including a holder, a spring, a bolt, and a nut; two supporting posts, each including a first contacting portion, a second contacting portion, and a connecting portion coupled; at lease one middle post including a top and a bottom horizontal sections, wherein the top horizontal section includes two sides, one of which includes a first extension to retain with the first slot and another of which includes a first recess to retain with the first pillar, the bottom horizontal section includes two sides, one of which includes a second extension to retain with the second slot and another of which includes a second recess to retain with the second pillar so that the middle post is connected between the two supporting posts.

5 Claims, 11 Drawing Sheets

ANGLE ADJUSTING STAND

BACKGROUND OF THE INVENTION

1. Field of the Invention

The present invention relates to an angle adjusting stand that is capable of being adjusted toward a desired angle based on requirement.

2. Description of the Prior Art

A conventional reading stand disclosed in TW Pat. No. 098223958 contains at least one bolt to engage at least two opposite toothed discs so as to further position a reading angle. However, when adjusting the reading angle, the bolt is rotated releasably to disengage the two toothed discs, and then one of the toothed discs is rotated toward a desired angle, thereafter the bolt is rotated tightly to engage the toothed discs, thus adjusting the reading angle of the reading stand.

However, such an angle adjusting method is complicated. Furthermore, a size of the reading book can not be increased or decreased based on the requirement.

The present invention has arisen to mitigate and/or obviate the afore-described disadvantages.

SUMMARY OF THE INVENTION

The primary object of the present invention is to provide an angle adjusting stand that is capable of being adjusted toward a desired angle based on requirement.

Another object of the present invention is to provide an angle adjusting stand that is capable of increasing or decreasing the number of the middle support to adjust the size of the angle adjusting stand.

To obtain the above objective, an angle adjusting stand provided by the present invention contains:

two bases, each including a hole, at least one limiting aperture, an engaging portion, and plural first locking faces; two adjusting devices, each including a holder, a spring, a bolt, and a nut; two supporting posts, each including a first contacting portion, a second contacting portion, and a connecting portion coupled; at lease one middle post including a top and a bottom horizontal sections, wherein the top horizontal section includes two sides, one of which includes a first extension to retain with the first slot and another of which includes a first recess to retain with the first pillar, the bottom horizontal section includes two sides, one of which includes a second extension to retain with the second slot and another of which includes a second recess to retain with the second pillar so that the middle post is connected between the two supporting posts.

BRIEF DESCRIPTION OF THE DRAWINGS

FIG. 6 is another cross sectional view showing the operation of the angle adjusting stand according to the first embodiment of the present invention;

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
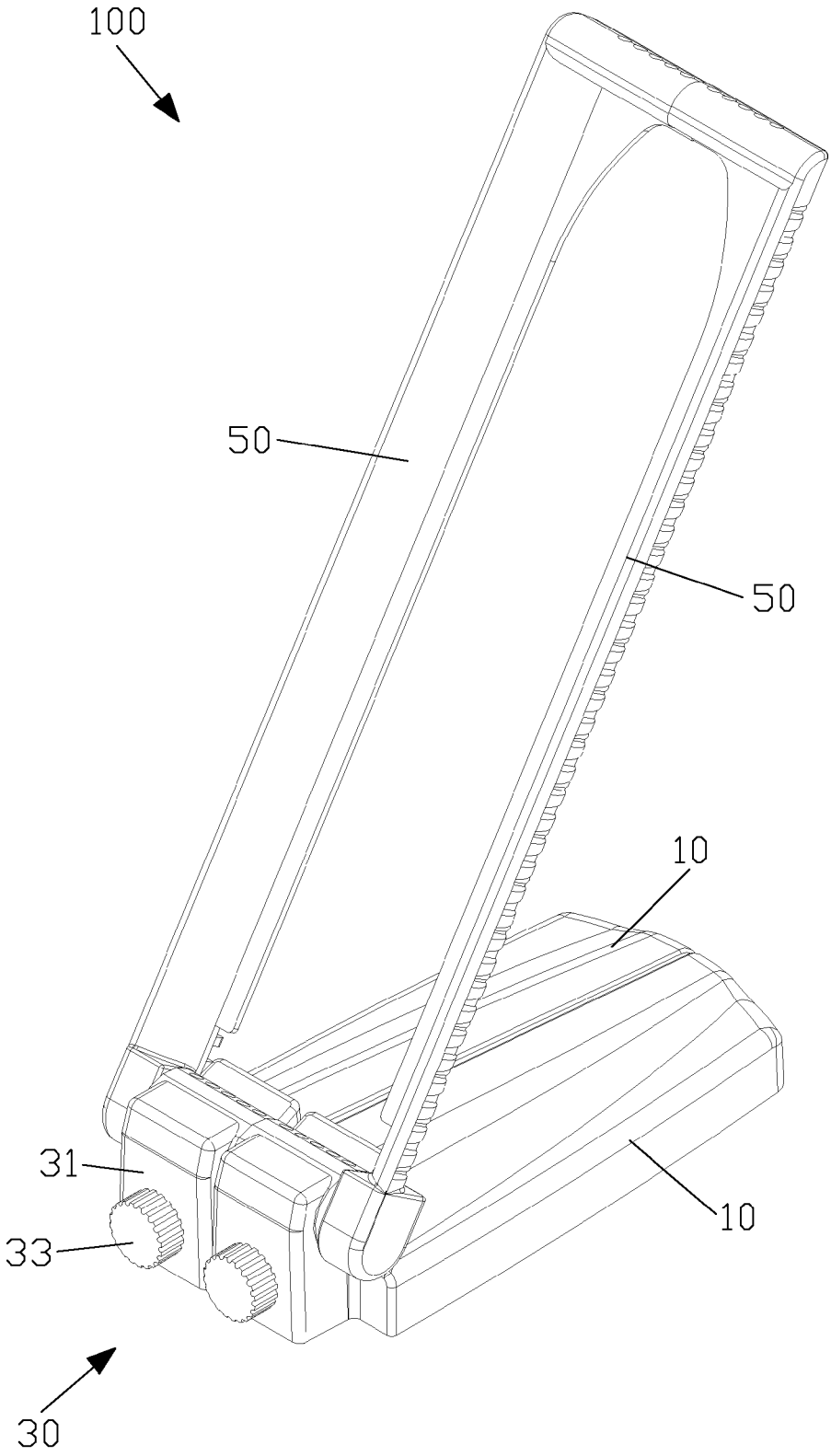
FIG. 1 is a perspective view showing the assembly of an angle adjusting stand according to a first embodiment of the present invention.
Figure 2:
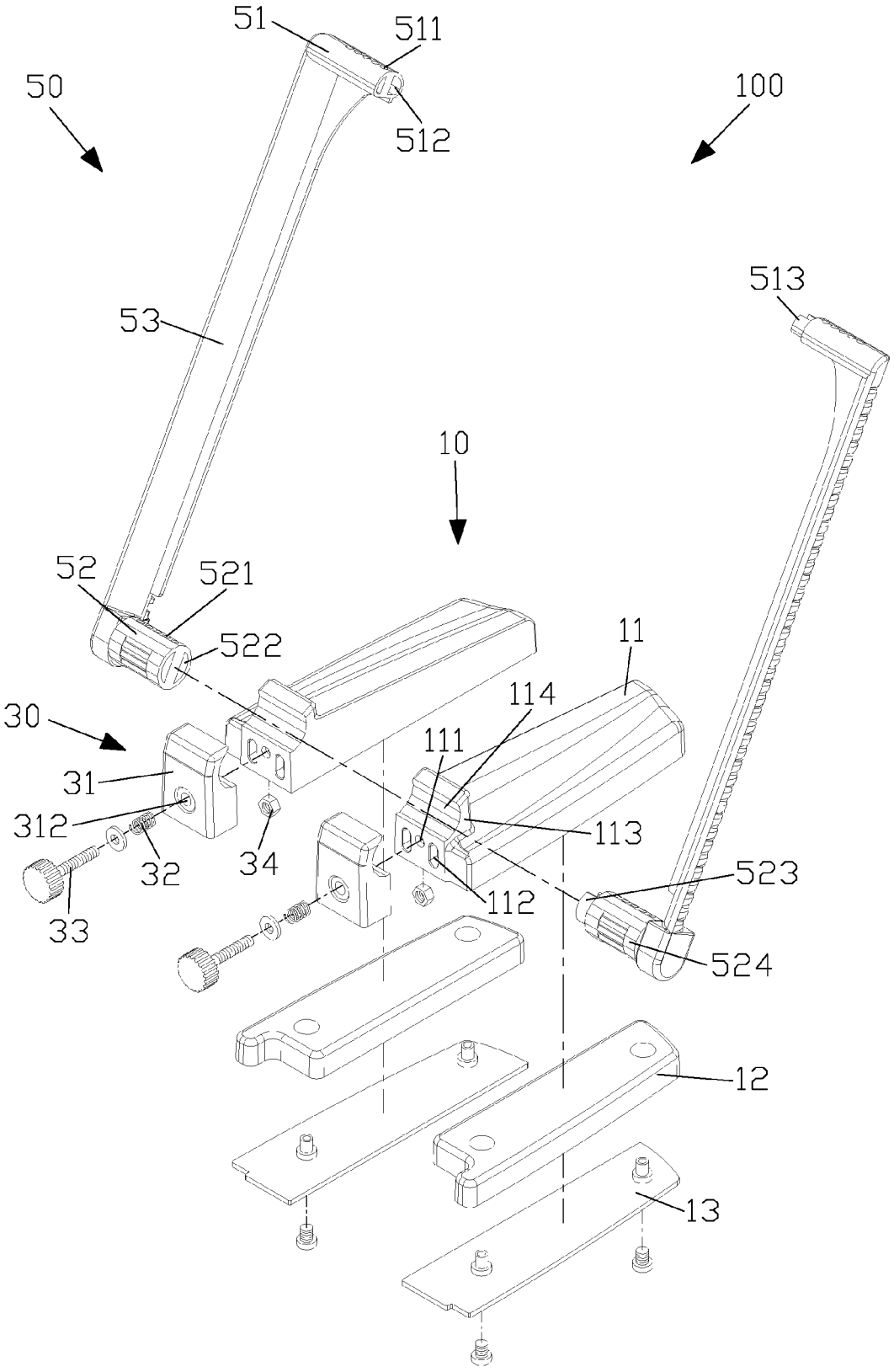
FIG. 2 is a perspective view showing the exploded components of the angle adjusting stand according to the first embodiment of the present invention.
Figure 3:
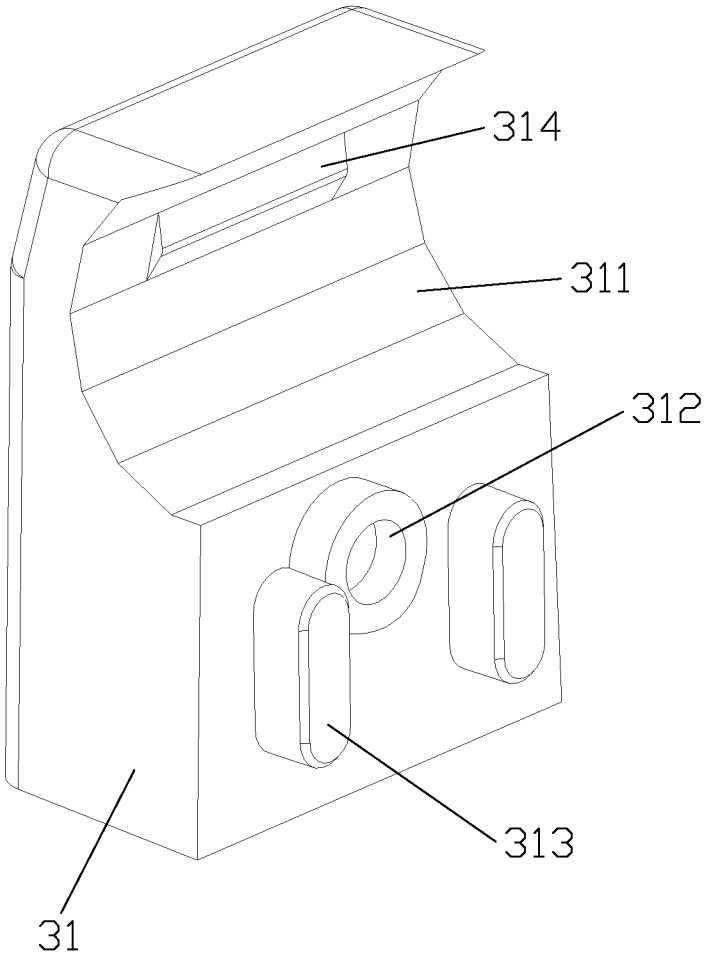
FIG. 3 is a perspective view showing the assembly of some components of the angle adjusting stand according to the first embodiment of the present invention.
Figure 4:
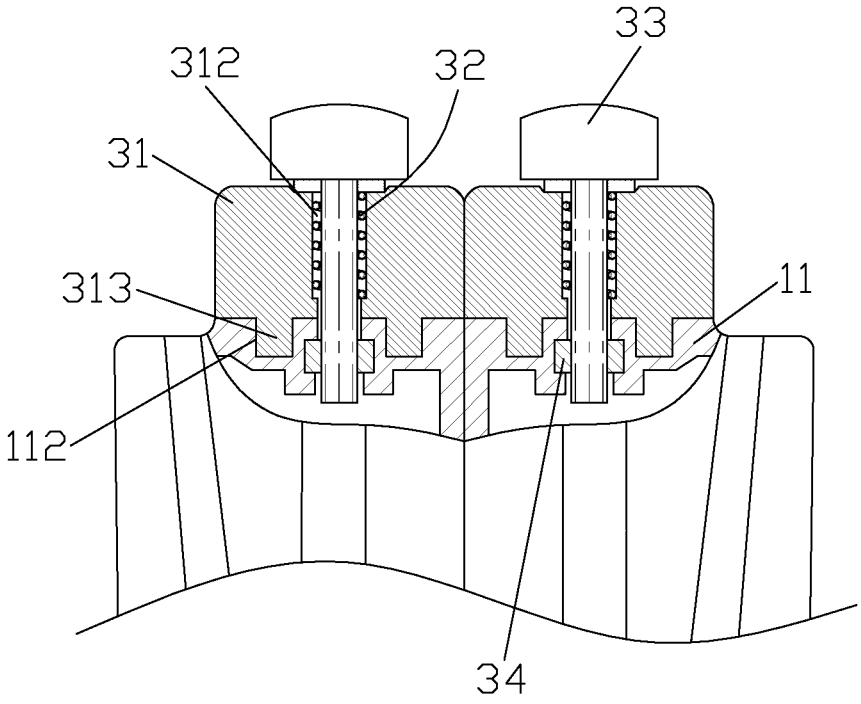
FIG. 4 is a cross sectional view showing the assembly of some components of the angle adjusting stand according to the first embodiment of the present invention.

Referring to FIGS. 1-8, an angle adjusting stand 100 in accordance with a first embodiment of the present invention comprises two bases 10, two adjusting devices 30, and two supporting posts 50, wherein each base 10, as shown in FIGS. 1 and 2, includes a housing 11, a counter weight 12, and a bottom lid 13. The housing 11 includes a hole 111 disposed on one end thereof and two limiting apertures 112 fixed on two sides of the hole 111 respectively, an engaging portion 113 extending upward from a top surface thereof adjacent to the hole 111, and a plurality of first locking faces 114 formed at a number of predetermined angles of an outer surface of the engaging portion 113 individually; the counter weight 12 is secured in the housing 11, and the bottom lid 13 is covered on a bottom end of the housing 11 so as to position the counter weight 12 in the housing 11, thereby preventing the counter weight 12 from disengagement and securing the base 10 by using the counter weight 12.

Referring to FIGS. 1-5, each adjusting device 30 includes a holder 31, a spring 32, a bolt 33, and a nut 34. The holder 31 includes a number of second locking faces 311 formed at a plurality of predetermined angles of a side surface of the holder 31 individually, and a retaining portion 314 extending from one of the second locking faces 311, an opening 312 adjacent to the second locking faces 311, and two limiting pegs 313 on two sides of the opening 312 respectively. The spring 32 is placed in the opening 312 and includes one end to abut against the holder 31, the bolt 33 is inserted into the hole 111 of the base 10 via the opening 312 of the holder 31 to screw with the nut 34 of the base 10 so that another end of the spring 32 is biased against the bolt 33, and the limiting peg 313 is inserted into the limiting aperture 112 of the base 10.

Figure 5:
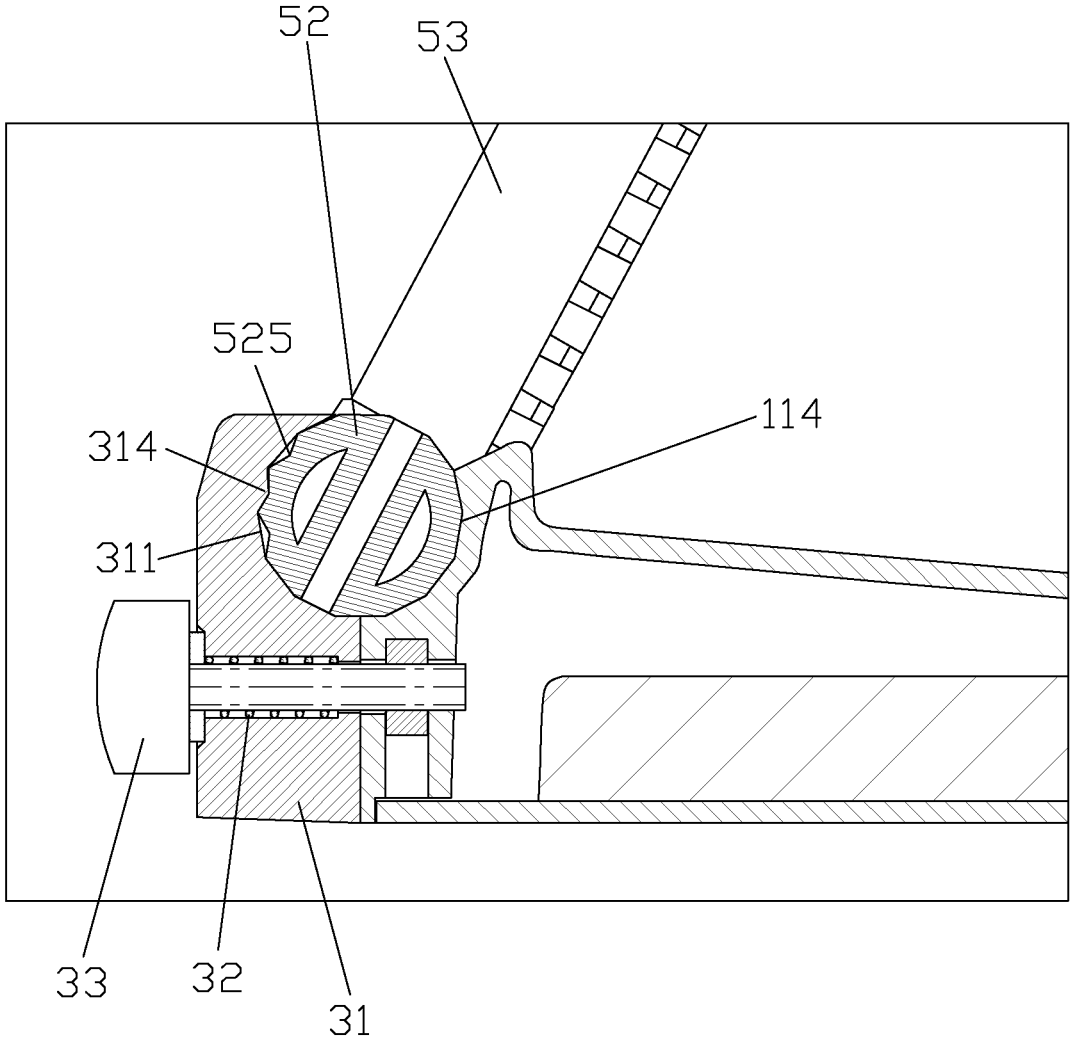
FIG. 5 is a cross sectional view showing the operation of the angle adjusting stand according to the preferred embodiment of the present invention

With reference to FIGS. 1, 2, and 5, each supporting post 50 includes a first contacting portion 51, a second contacting portion 52, and a connecting portion 53 coupled between the first contacting portion 51 and the second contacting portion 52. The first contacting portion 51 includes a plurality of first bores 511, and the second contacting portion 52 includes a number of second bores 521, the first contacting portion 51 of one supporting post 50 includes at lease one first slot 512 disposed on one side end thereof, and the second contacting portions 52 of the one supporting post 50 includes at least one second slot 522 arranged on one side end thereof, while the first contacting portion 51 of another supporting post 50 includes at least one first pillar 513 secured on one side end thereof, and the second contacting portion 52 of the another supporting post 50 includes at least one second pillar 523 secured on one side end thereof, the second contacting portions 52 of the supporting posts 50 include a plurality of third locking faces 524 disposed on outer surfaces thereof respectively, and three of the third locking faces 524 includes three grooves 525 individually so that the second contacting portion 52 is retained by the base 10 and the adjusting device 30, i.e., the third locking faces 524 of the second contacting portion 52 are retained by the first locking faces 114 of the bases 10 and the second locking faces 311 of the adjusting devices 30 individually, and the retaining portion 314 of the adjusting device 30 is retained in one of the grooves 525, the first slot 512 and the second slot 522 of the one supporting post 50 are retained with the first pillar 513 and the second pillar 523 of the another supporting post 50 individually.

Figure 6:
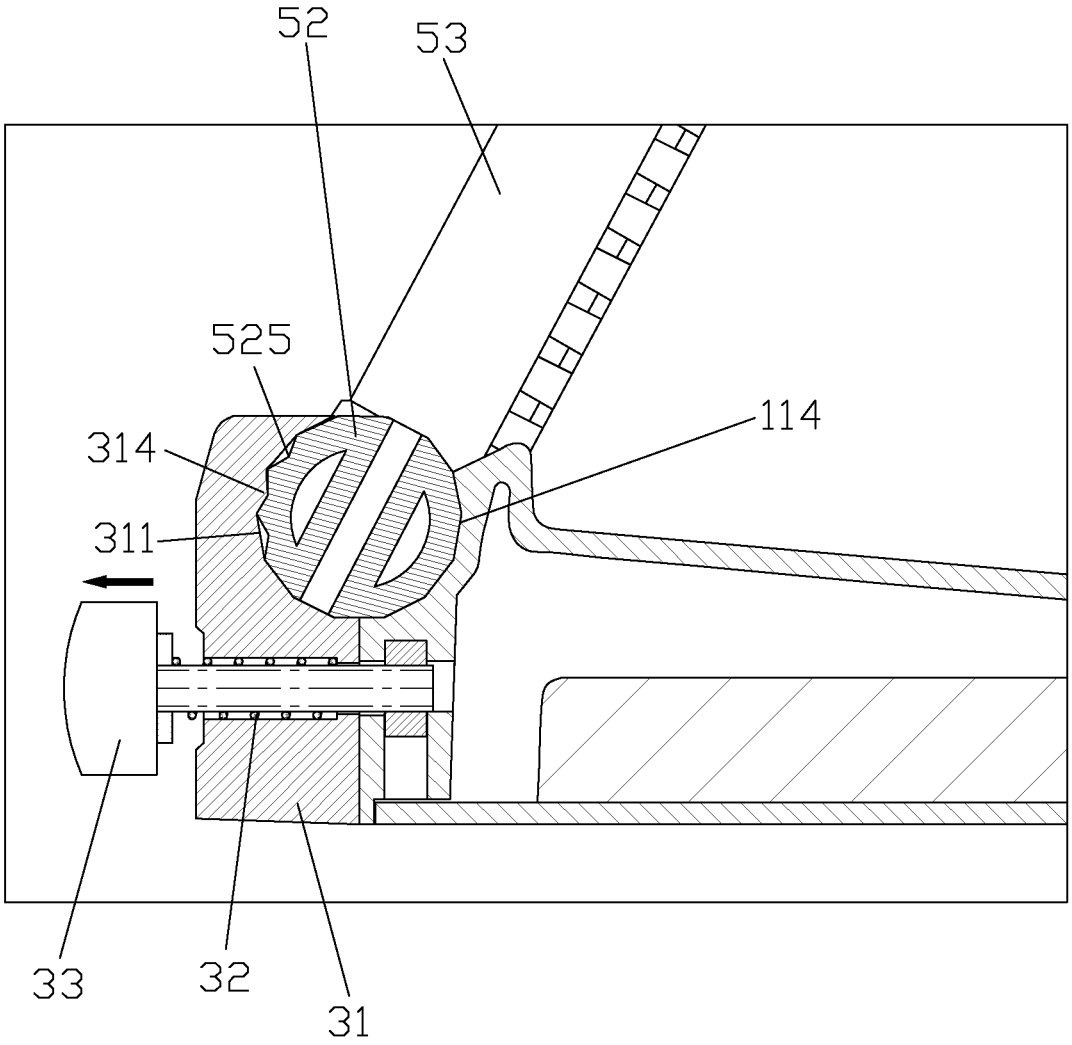
FIG. 6 is a perspective view showing the operation of the positioning structure for the document box according to the first embodiment of the present invention.
Figure 7:
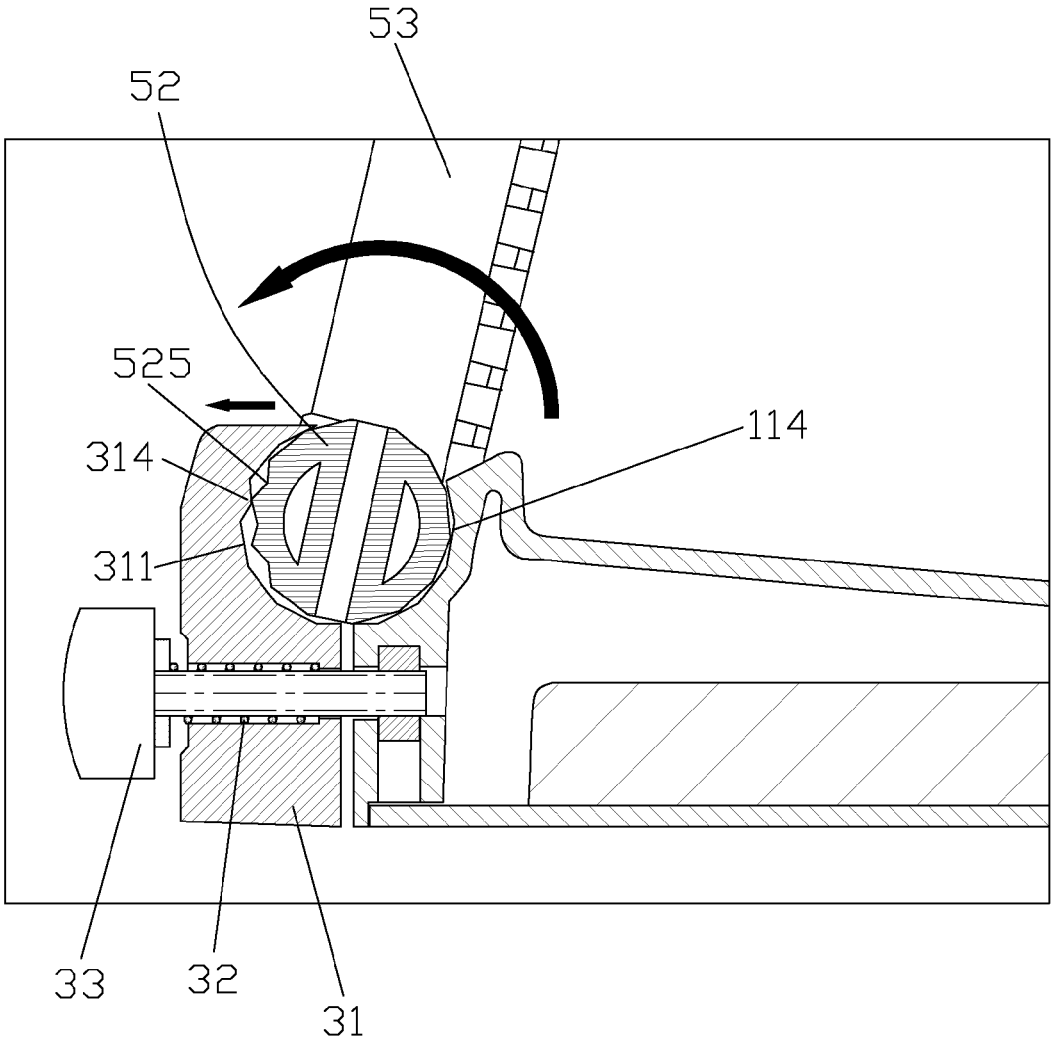
FIG. 7 is also another cross sectional view showing the operation of the angle adjusting stand according to the first embodiment of the present invention.
Figure 8:
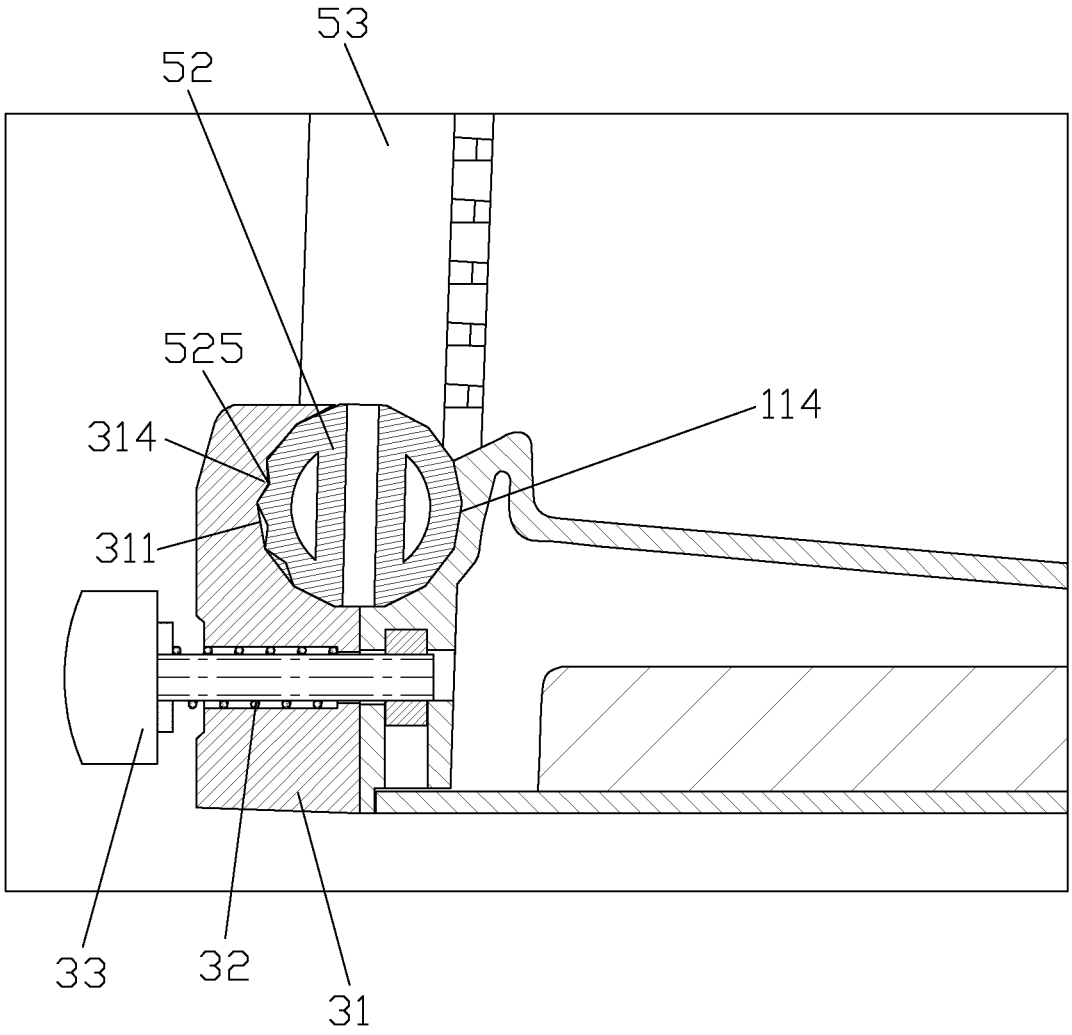
FIG. 8 is still another cross sectional view showing the operation of the angle adjusting stand according to the first embodiment of the present invention.

When desiring to adjust the supporting post 50 to be opposite to the base 10, the bolt 33 is rotated releasably (as illustrated in FIG. 6), and the supporting post 50 is rotated along the second contacting portion 52, thereafter the spring 32 of the adjusting device 30 pushes the holder 31 to move toward the base 10 so that the holder 31 is pushed lightly (as shown in FIG. 7) when the supporting post 50 rotates, and after the third locking face 524 of the supporting post 50 contacts with the first locking face 114 of the base 10 and the second locking face 311 of the adjusting device 30, the spring 32 pushes the holder 31 toward the base 10 to position the supporting post 50 (as illustrated in FIG. 8), then the bolt 33 is rotated tightly to adjust the supporting post 50 to be fixed at a desired angle.

Figure 9:
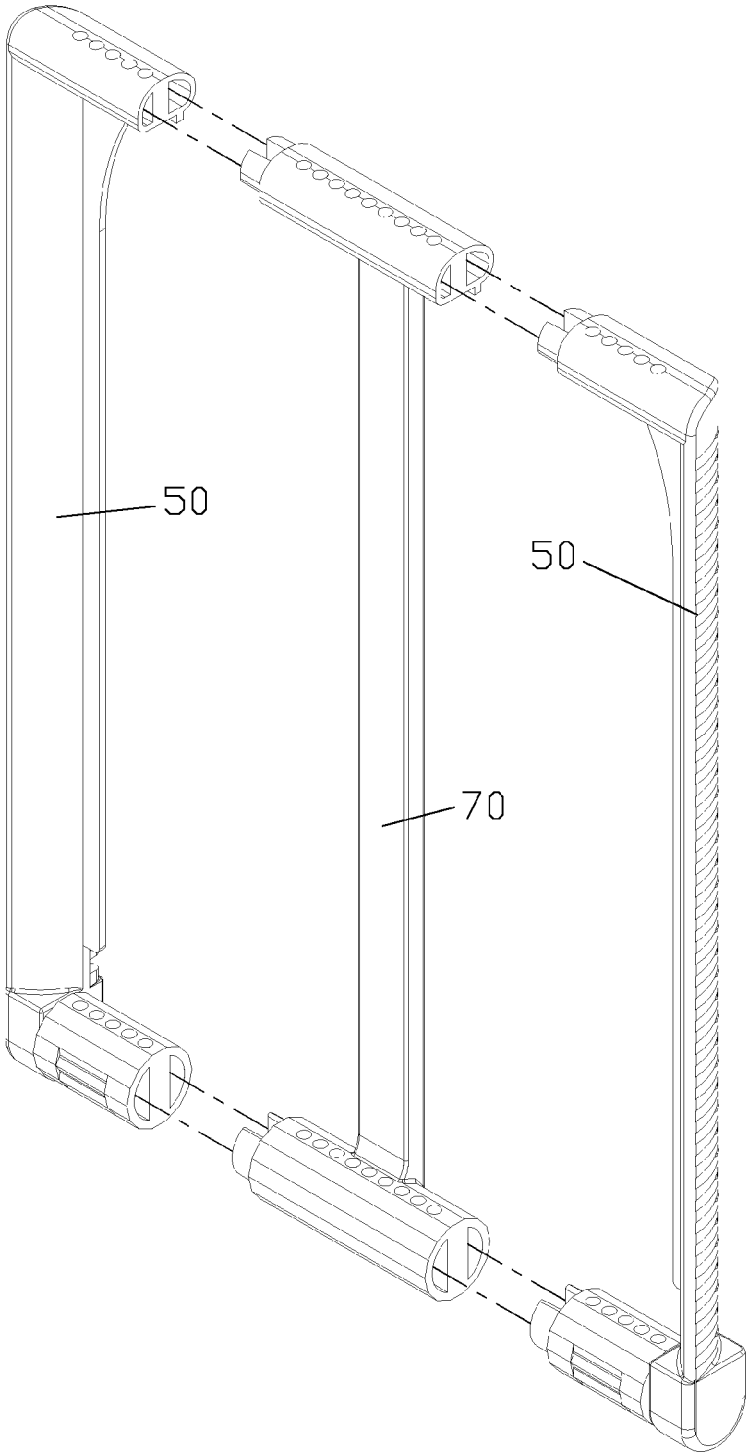
FIG. 9 is a perspective view showing the exploded components of an angle adjusting stand according to a second embodiment of the present invention.
Figure 10:
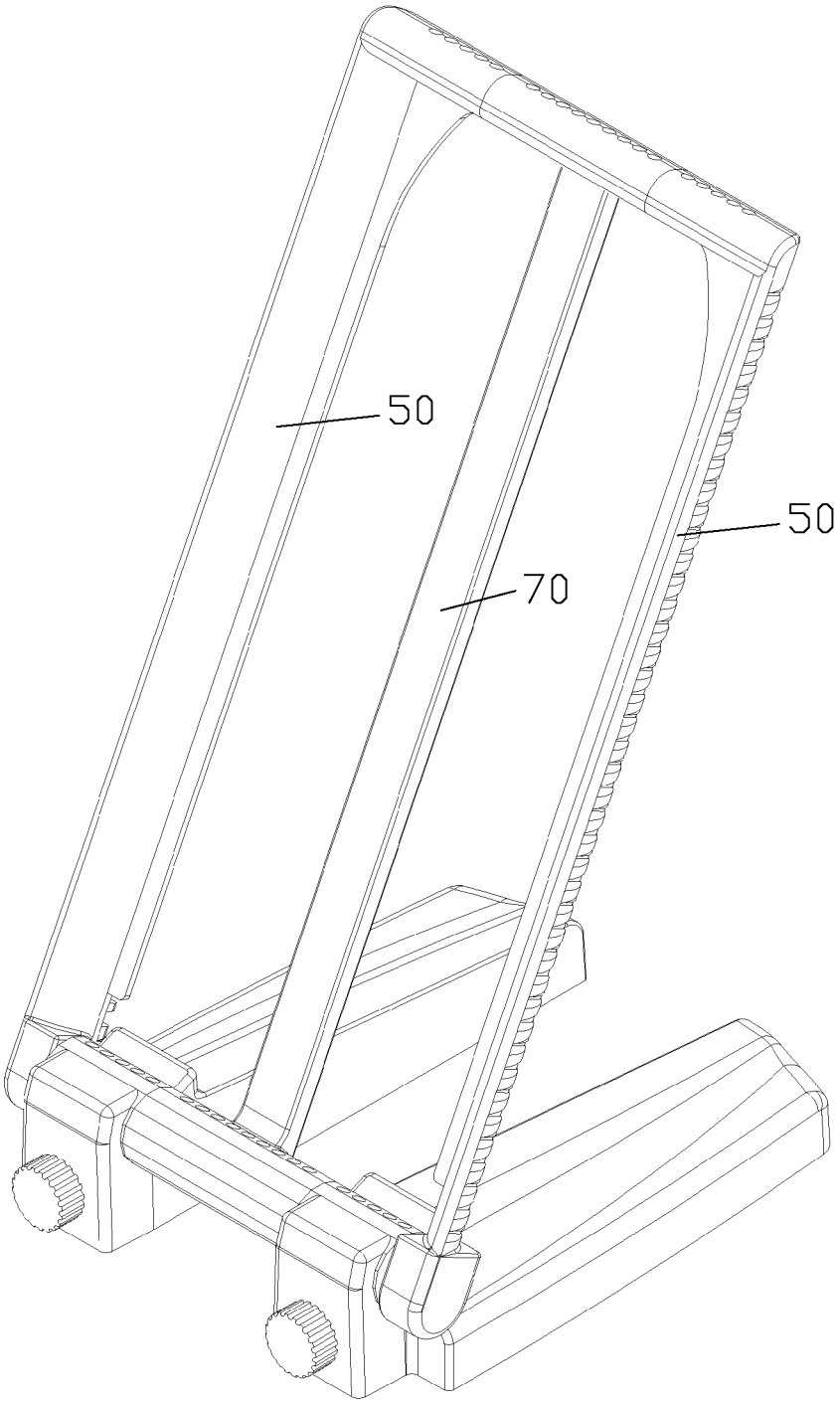
FIG. 10 is a perspective view showing the exploded components of the angle adjusting stand according to the second embodiment of the present invention.
Figure 11:
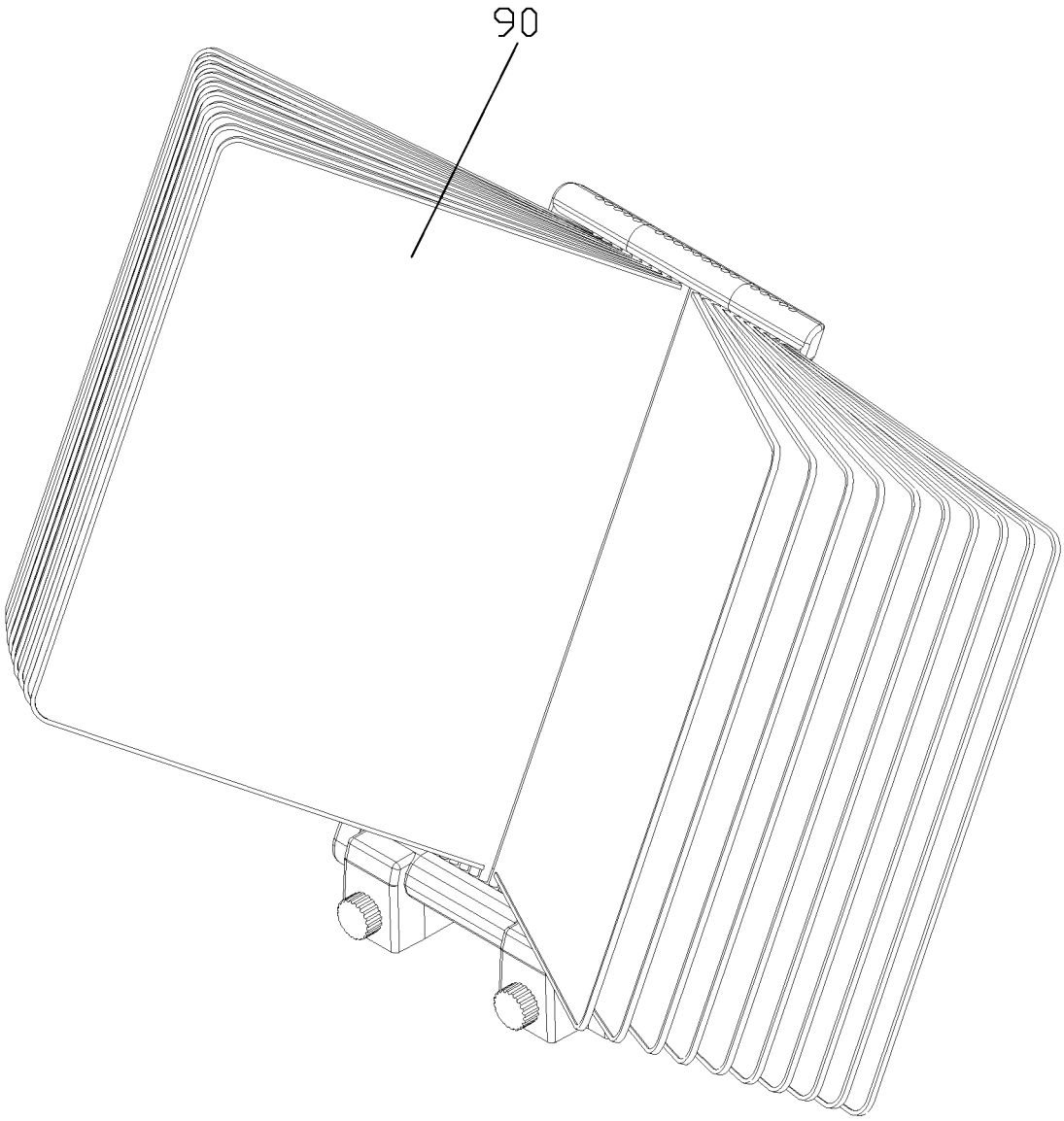
FIG. 11 is a perspective view showing the operation of the angle adjusting stand according to the first embodiment of the present invention.

Referring to FIG. 9-10, a difference of an angle adjusting stand of a second embodiment of the present invention from that of the first embodiment comprises at lease one middle post 70, wherein the middle post 70 includes a top horizontal section and a bottom horizontal section, wherein the top horizontal section includes two sides, one of which includes a first extension to retain with the first slot 512 and another of which includes a first recess to retain with the first pillar 513, the bottom horizontal section includes two sides, one of which includes a second extension to retain with the second slot 522 and another of which includes a second recess to retain with the second pillar 523 so that the middle post 70 is connected between the two supporting posts 50. Thereby, a number of the middle post 70 is increased so that a size of the angle adjusting stand becomes large to provided with more first bores 511 and more second bores 521 so as to insert more data sheets 90 (as illustrated in FIG. 11). In other words, the size of the angle adjusting stand is capable of being adjusted by ways of increasing or decreasing the number of the middle support 70.

While we have shown and described various embodiments in accordance with the present invention, it is clear to those skilled in the art that further embodiments may be made without departing from the scope of the present invention.

What is claimed is:

1. An angle adjusting stand comprising:

two bases, each including a hole disposed on one end thereof, at least one limiting aperture fixed on two sides of the hole respectively, and an engaging portion extending upward from a top surface thereof adjacent to the hole, and a plurality of first locking faces formed at a number of predetermined angles of an outer surface of the engaging portion individually;

two adjusting devices, each including a holder, a spring, a bolt, and a nut, the holder including a number of second locking faces formed at a plurality of predetermined angles of a side surface of the holder individually, and a retaining portion extending from one of the second locking faces, an opening adjacent to the second locking faces, and two limiting pegs on two sides of the opening respectively, wherein the spring is placed in the opening, the bolt is inserted into the hole of the base via the opening of the holder to screw with the nut of the base, and the limiting peg is inserted into the limiting aperture of the base;

two supporting posts, each including a first contacting portion, a second contacting portion, and a connecting portion coupled between the first contacting portion and the second contacting portion, the first contacting portion including a plurality of first bores, and the second contacting portion including a number of second bores, the first contacting portion of one supporting post including at lease one first slot disposed on one side end thereof, and the second contacting portions of the one supporting post including at least one second slot arranged on one side end thereof, the first contacting portion of another supporting post including at least one first pillar secured on one side end thereof, and the second contacting portion of the another supporting post including at least one second pillar secured on one side end thereof, the second contacting portions of the supporting posts including a plurality of third locking faces disposed on outer surfaces thereof respectively, and three of the third locking faces includes three grooves individually so that the second contacting portion is retained by the base and the adjusting device, the third locking faces of the second contacting portion being retained by the first locking faces of the bases and the second locking faces of the adjusting devices individually, and the retaining portion of the adjusting device is retained in one of the grooves, the first slot and the second slot of the one supporting post are retained with the first pillar and the second pillar of the another supporting post individually.

2. The angle adjusting stand as claimed in claim 1, wherein the base includes housing, a counter weight, and a bottom lid; the housing includes the hole, the two limiting apertures, and the first locking faces; the counter weight is secured in the housing, and the bottom lid is covered on a bottom end of the housing.

3. The angle adjusting stand as claimed in claim 1, wherein the spring includes one end to abut against the holder and another end biased against the bolt.

4. The angle adjusting stand as claimed in claim 1 further comprising at lease one middle post, the middle post including a top horizontal section and a bottom horizontal section, wherein the top horizontal section includes two sides, one of which includes a first extension to retain with the first slot and another of which includes a first recess to retain with the first pillar, the bottom horizontal section includes two sides, one of which includes a second extension to retain with the second slot and another of which includes a second recess to retain with the second pillar so that the middle post is connected between the two supporting posts.

5. The angle adjusting stand as claimed in claim 1, wherein the first bores of the first contacting portion and the second bores of the second contacting portion are provided to insert a plurality of data sheets.

* * * * *